US012433375B2

(12) United States Patent
Lu

(10) Patent No.: US 12,433,375 B2
(45) Date of Patent: Oct. 7, 2025

(54) SLIDER OF ZIPPER AND ZIPPER

(71) Applicant: Zhejiang Huashengda Zipper Technology Co., Ltd., Jiaxing (CN)

(72) Inventor: Hao Lu, Jiaxing (CN)

(73) Assignee: ZHEJIANG HUASHENGDA ZIPPER TECHNOLOGY CO., LTD., Jiaxing (CN)

( * ) Notice: Subject to any disclaimer, the term of this patent is extended or adjusted under 35 U.S.C. 154(b) by 0 days.

(21) Appl. No.: 18/446,669

(22) Filed: Aug. 9, 2023

(65) Prior Publication Data

US 2023/0380548 A1 Nov. 30, 2023

Related U.S. Application Data

(63) Continuation of application No. PCT/CN2021/076329, filed on Feb. 9, 2021.

(51) Int. Cl.
*A44B 19/28* (2006.01)
*A44B 19/26* (2006.01)

(52) U.S. Cl.
CPC ..... *A44B 19/28* (2013.01); *A44B 19/262* (2013.01)

(58) Field of Classification Search
CPC ..... A44B 19/28; A44B 19/262; A44B 19/26
See application file for complete search history.

(56) References Cited

U.S. PATENT DOCUMENTS

| | | | | |
|---|---|---|---|---|
| 9,877,550 | B1 * | 1/2018 | Chen | A44B 19/262 |
| 2011/0126383 | A1 * | 6/2011 | Takazawa | A44B 19/32 24/389 |
| 2012/0096687 | A1 * | 4/2012 | Huotari | A44B 19/26 24/426 |
| 2012/0117765 | A1 * | 5/2012 | Damon | A44B 19/38 24/406 |

(Continued)

FOREIGN PATENT DOCUMENTS

| | | | |
|---|---|---|---|
| CN | 110250667 | A | 9/2019 |
| JP | 3162237 | U | 8/2010 |

(Continued)

OTHER PUBLICATIONS

International Search Report dated Nov. 1, 2021; International Application No. PCT/CN2021/076329; 3 pages (non-English).

(Continued)

*Primary Examiner* — David M Upchurch
(74) *Attorney, Agent, or Firm* — CANTOR COLBURN LLP

(57) ABSTRACT

A slider of the zipper, including: a slider body including an upper guide plate and a lower guide plate connected to each other and a pull tab, guide Guide channels are formed between the upper guide plate and the lower guide plate, and the guide channel at one side may allow insertion and withdrawal of the zipper teeth at corresponding side; the pull tab is movably connected to the upper guide plate, the pull tab includes an assistive insertion member on which a track channel running through its two ends is formed; the assistive (Continued)

insertion member may be flipped upwards relative to the slider body, such that the track channel is in communication with the guide channel at corresponding side, and a pin of the zipper teeth at corresponding side may enter inside of the slider body through the track channel.

16 Claims, 8 Drawing Sheets

(56) References Cited

U.S. PATENT DOCUMENTS

2020/0015554 A1* 1/2020 Takazawa ..... A44B 19/36

FOREIGN PATENT DOCUMENTS

| | | | |
|---|---|---|---|
| JP | 2016209504 | A | 12/2016 |
| KR | 20090070088 | A | 7/2009 |
| KR | 20110116800 | A | 10/2011 |

OTHER PUBLICATIONS

International Search Report dated Nov. 1, 2021; International Application No. PCT/CN2021/076329; 2 pages (English).
Written Opinion dated Nov. 1, 2021; International Application No. PCT/CN2021/076329; 3 pages (non-English).

* cited by examiner

SLIDER OF ZIPPER AND ZIPPER

CROSS-REFERENCE TO RELATED APPLICATIONS

This disclosure is a Continuation Application of PCT application No. PCT/CN2021/076329, filed on Feb. 9, 2021, the contents of which are incorporated herein by reference.

TECHNICAL FIELD

The present disclosure relates to the technical field of zipper, and more particularly, relates to a slider of a zipper and a zipper.

BACKGROUND

To correctly use a zipper in daily life, a user needs to accurately insert the pin at the bottom of the zipper teeth chain into the slider. This insert operation of the zipper is not difficult for general people. However, for some people such as children, old people and disabled people having difficulty in hands movement and the like, it is difficult to accurately perform the insert operation when using the zipper. With regard to this problem, the industry has provided some improvements, such as adding an assistive insertion component such as a wider slider cover at the slider of the zipper. But on one hand, this design requires additional assembly and high cost, and on the other hand, the design also increases the volume of the slider and make it bulky and redundant. Therefore, it is an urgent problem to be solved to develop a zipper with a simple structure and easy insert operation.

SUMMARY

An object of the embodiments of the application is to provide a slider of a zipper to solve the technical problem of difficult insert operation of a zipper in the prior art.

To solve the above technical problem, the embodiments of the disclosure adopt the following technical solutions:

A first aspect of the disclosure provides a slider of a zipper, the zipper includes tapes arranged at opposing left side and right side and zipper teeth arranged on the tapes, the slider of the zipper includes:

a slider body including an upper guide plate and a lower guide plate connected to each other, two guide channels at the left side and the right side are formed between the upper guide plate and the lower guide plate to engage and separate the zipper teeth, and the guide channel at one side may allow insertion and withdrawal of the zipper teeth at corresponding side; and a pull tab movably connected to the upper guide plate, the pull tab includes an assistive insertion member on which a track channel running through its two ends is formed; the assistive insertion member may be flipped upwards relative to the slider body, such that the track channel is in communication with the guide channel at corresponding side, and a pin of the zipper teeth at corresponding side may enter inside of the slider body through the track channel.

In one embodiment, the assistive insertion member includes a connection portion connected to the upper guide plate and a track portion connected to the connection portion, the assistive insertion member has a use state resulted from flipping the connection portion together with the track portion upwards relative to the upper guide plate;

the zipper teeth include a first zipper teeth capable of free insertion and withdrawal, the guide channels include a first guide channel for insertion of the first zipper teeth; the track portion is provided at same side as the first guide channel, the track channel is formed on the track portion, and the track channel has a track guide inlet facing away from the first guide channel and a track guide outlet facing the first guide channel;

the track channel flares out along a width direction of the slider body.

In one embodiment, in the use state, taking a direction from the upper guide plate to the lower guide plate as a direction from top to bottom, cross section of the track portion is L-shaped, and the track portion comprises a first track plate and a second track plate, the first track plate is formed by extending downward from the connection portion, the second track plate is formed by extending outward from a lower edge of the first track plate in the width direction of the slider body, and the track channel is enclosed by inner sides of the first track plate and the second track plate.

In one embodiment, in the use state, taking a direction from the upper guide plate to the lower guide plate as a direction from top to bottom, the track portion is provided as a one-piece downwardly curved plate, an inner side of the curved plate is a smooth curved surface, and the track channel is enclosed by the inner side of the curved plate.

In one embodiment, the connection portion is provided with a notch in communication with the track channel.

In one embodiment, length of the notch is less than or equal to length of a pin of the first zipper teeth.

In one embodiment, in the use state, taking a direction from the slider body to the assistive insertion member as a direction from front to rear, the notch has a notch rear edge away from the slider body, and the track portion has a track rear edge away from the slider body;

in the width direction of the slider body, the notch rear edge is arranged to be tilted backwards, and the track rear edge is arranged to be tilted forwards.

In one embodiment, the assistive insertion member further includes a grip portion disposed at an end of the connection portion and the track portion facing away from the slider body.

In one embodiment, in the use state, taking a direction from the slider body to the assistive insertion member as a direction from front to rear and taking a direction from the upper guide plate to the lower guide plate as a direction from top to bottom, the grip portion is arranged to be tilted upwards in a backward direction.

In one embodiment, anti-slip ribs are provided on the grip portion.

In one embodiment, the pull tab further includes a connecting member, one end of the connecting member is pivotally connected to the upper guide plate, and other end of the connecting member is fixedly connected to the assistive insertion member; or the connecting member is integrally provided with the assistive insertion member, and one end of the connecting member facing the slider body is pivotally connected to the upper guide plate.

In one embodiment, the assistive insertion member is made of a soft elastic material.

In one embodiment, the track channel flares out in a direction away from the slider body.

In one embodiment, in a length direction of the tapes, length of the track channel is greater than length of the slider body; and in a width direction of the tapes, width of the track channel is greater than width of the guide channel at corresponding side.

In one embodiment, height of the track channel is greater than height of the slider body.

A second aspect of the disclosure provides a zipper including the above-mentioned slider of the zipper.

The slider of the zipper provided by the embodiments of the disclosure has the following benefits: because of the assistive insertion member provided on the pull tab, a user may perform an accurate and convenient insert operation of the zipper through the following several simple steps: STEP ONE, flipping the pull tab upwards relative to the slider body to the other side; STEP TWO, inserting the pin at the bottom of the zipper teeth into the track channel from one end of the track channel of the assistive insertion member; and STEP THREE, making the pin of the zipper teeth to thus enter the slider body under the guide of the track channel, since the track channel is in communication with the guide channel at the corresponding side of the slider body, thereby completing an accurate insert operation of the zipper. As may be seen from the above use process, compared with existing assistive insertion solutions in the industry, the solution of the disclosure decomposes the insert operation of the zipper into three simple steps-flipping, then forming an insertion track, and then quickly, conveniently and accurately inserting in the slider body, which not only may achieve the purpose of allowing old people, children, disabled people having difficulty in hands movement and even regular people to more conveniently and accurately perform the insert operation of the zipper. In addition, the disclosure uses the design of the pull tab of the zipper itself without adding any component on the slider body, and the designed pull tab of the disclosure does not have any risk of falling off as the component direct added on the slider body, and therefore, the solution of the disclosure has the advantages of being simpler and safer in structure and more aligned with the use logic.

BRIEF DESCRIPTION OF THE DRAWINGS

In order to more clearly explain the technical solutions in the embodiments of the disclosure, the following provides a brief description of the attached drawings necessary in the embodiments or in the exemplary technical descriptions. Obviously, the drawings in the following description are merely some embodiments of the disclosure, and those skilled in the art may also obtain other drawings according to these drawings without paying creative labor.

DETAILED DESCRIPTION OF THE EMBODIMENTS

Figure 1:
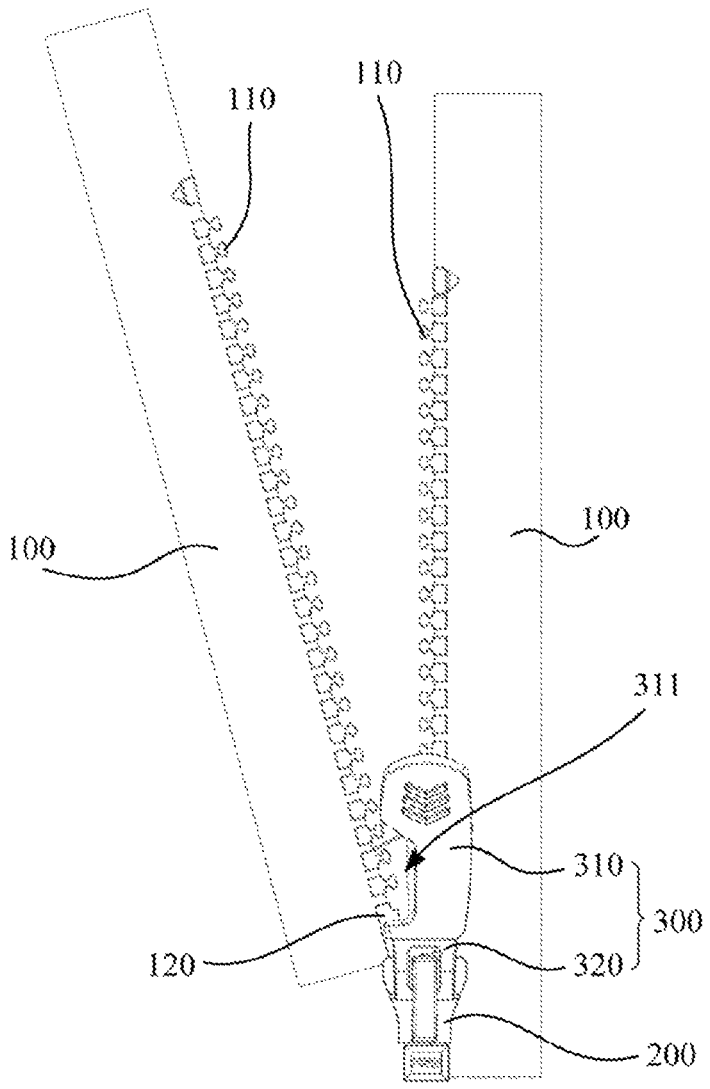
FIG. 1 is a schematic structure diagram of a zipper provided in one embodiment of the disclosure which is in a use state.

To make the objectives, technical solutions and advantages of the disclosure clearer, the disclosure is further described in detail below with reference to the accompanying drawings and embodiments. It should be understood that the specific embodiments described herein are merely used to explain the disclosure rather than limit it.

It should be noted that when a component is referred to as being "fixed to" or "disposed on" another component, it may be directly on or indirectly on another component. When one component is referred to as being "connected to" another component, it may be directly or indirectly connected to another component. The orientation or positional relationship indicated by the terms "upper", "lower", "left", "right" and the like is based on the orientation or positional relationship shown in the drawings, and is only for ease of description, rather than indicating or implying that the referred device or element must have a specific orientation, be constructed or operated in a specific orientation, and cannot be construed as a limitation to the disclosure. Those skilled in the art may understand the specific meaning of the above-mentioned terms according to specific situations. The terms "first" and "second" are only used for ease of description, and cannot be construed as indicating or implying relative importance or implicitly indicating the number of the technical features. The meaning of "a plurality of" is two or more, unless specifically defined otherwise.

In order to illustrate the technical solutions provided in the disclosure, the following detailed description is made in conjunction with the specific accompanying drawings and the embodiments.

The embodiments of the disclosure provide a slider of a zipper.

Figure 2:
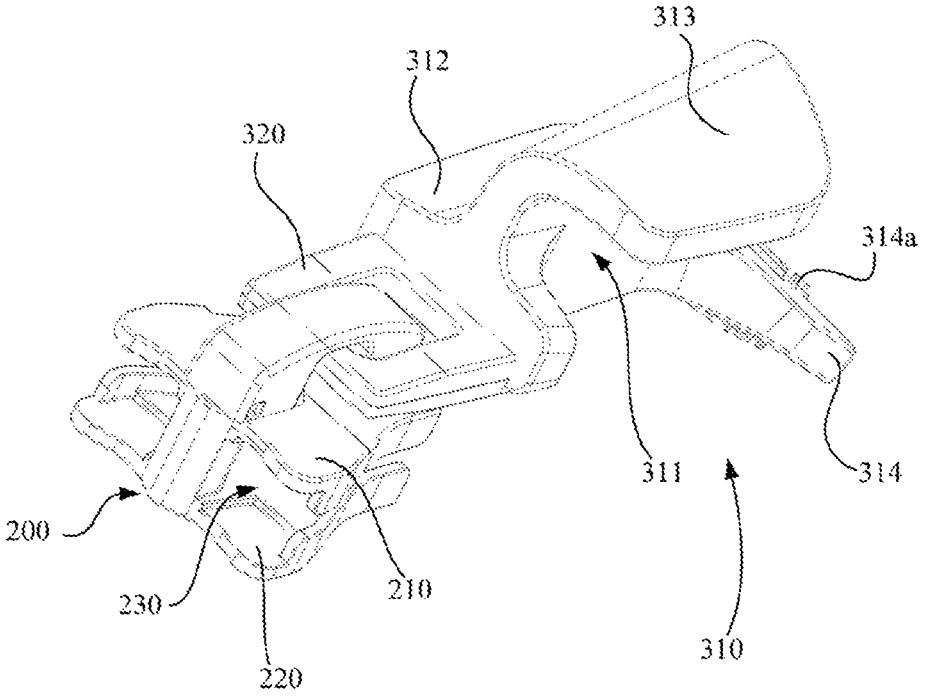
FIG. 2 is a schematic structure diagram of a slider of a zipper provided in one embodiment of the disclosure which is in a non-use state.
Figure 3:
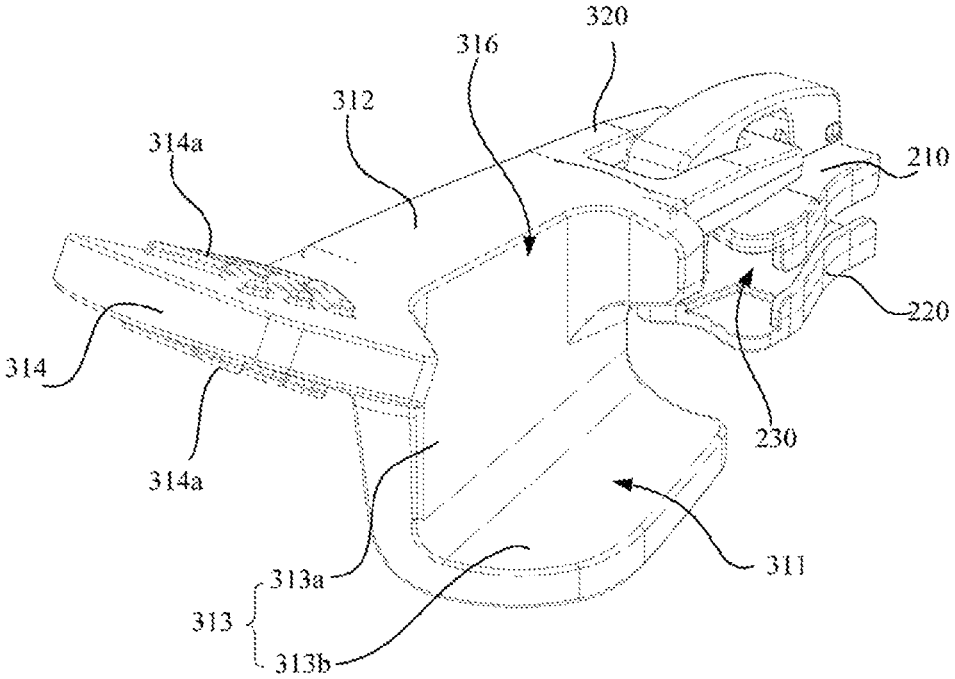
FIG. 3 is a schematic structure diagram of a slider of a zipper provided in one embodiment of the disclosure which is in a use state.

Please refer to FIG. 1 to FIG. 3. In one embodiment, the zipper includes tapes 100 arranged at opposing left side and right side and zipper teeth 110 arranged on the tapes 100. The slider of the zipper includes a slider body 200 and a pull tab 300. Specifically, the slider body 200 includes an upper guide plate 210 and a lower guide plate 220 connected to each other, and two guide channels 230 at the left side and the right side are formed between the upper guide plate 210 and the lower guide plate 220 to engage and separate the zipper teeth, where a guide channel 230 at one side may allow the insertion and withdrawal of the zipper teeth at one corresponding side. The pull tab 300 is movably connected to the upper guide plate 210, and includes an assistive insertion member 310 on which a track channel 311 running through its two ends is formed. The assistive insertion member 310 may be flipped upwards relative to the slider body 200, so that the track channel 311 is in communication with a guide channel 230 at a corresponding side, and the pin 120 of the zipper teeth 110 at the corresponding side may enter the inside of the slider body 200 through the track channel 311.

Based on this structural design, in the embodiment, because of the assistive insertion member 310 provided on the pull tab 300, a user may perform an accurate and convenient insert operation of the zipper through the following several simple steps: STEP ONE, flipping the pull tab 300 upwards relative to the slider body to the other side; STEP TWO, inserting the pin 120 at the bottom of the zipper teeth 110 into the track channel 311 from one end of the track channel 311 of the assistive insertion member 310; and STEP THREE, making the pin 120 of the zipper teeth 110 to thus enter the slider body under the guide of the track channel 311, since the track channel 311 is in communication with the guide channel 230 at the corresponding side of the slider body, thereby completing an accurate insert operation of the zipper. As may be seen from the above use process, compared with existing assistive insertion solutions in the industry, the solution of the disclosure decomposes the insert operation of the zipper into three simple steps of flipping, then forming an insertion track, and then quickly, conveniently and accurately inserting in the slider body, which not only may achieve the purpose of allowing old people, children, disabled people having difficulty in hands movement and even regular people to more conveniently and accurately perform the insert operation of the zipper. In addition, the disclosure uses the design of the pull tab 300 of the zipper itself without adding any component on the slider body 200, and the designed pull tab 300 of the disclosure does not have any risk of falling off as the component direct added on the slider body 200, and therefore, the solution of the disclosure has the advantages of being simpler and safer in structure and more aligned with the use logic.

Please refer to FIG. 1 to FIG. 3. Specifically in one embodiment, the pull tab 300 further includes a connecting member 320, one end of the connecting member 320 is pivotally connected to the upper guide plate 210, and the other end of the connecting member 320 is fixedly connected to the assistive insertion member 310. In this case, the slider body and the connecting member 320 may be made of a material selected from commonly used metals or plastic and others and have a structure of conventional design, and the assistive insertion piece 310 is made of the same or different materials such as plastic, and then the two are connected together in various ways. Certainly, in other embodiments, the connecting member 320 may also be integrally provided with the assistive insertion member 310, that is, they are integrally manufactured by using the same material, and then one end of the connecting member 320 facing the slider body 200 is pivotally connected to the upper guide plate 210.

Specifically, in the embodiment, the assistive insertion member 310 includes a connection portion 312 connected to the upper guide plate 210 and a track portion 313 connected to the connection portion 312, and the connection portion 312 mainly functions as a connection therebetween. Specifically, the connection portion 312 may be pivotally connected to the upper guide plate 210 through the connecting member 320, and it is the track portion 313 provided with the track channel 311 that functions to guide the insertion. In actual use, the assistive insertion member 310 has a use state as shown in FIG. 1 and FIG. 3, which is resulted from flipping the connection portion 312 together with the track portion 313 upwards relative to the upper guide plate 210. Certainly, in case where there is no need to perform an insert operation of the zipper, the assistive insertion member and the connecting member 320 may be in a non-use state as a conventional zipper pull tab 300, as shown in FIG. 2 where the pull tab 300 is facing downwards. It should be noted herein that the shape of the assistive insertion member 310 is not limited to those shown in FIG. 1 to FIG. 3. As long as the function of assisting the insertion is satisfied, the shape and color of the assistive insertion member 310 may be set according to actual requirements. For example, in various embodiments shown in FIG. 6 to FIG. 11, the assistive insertion member 310 may be in various shapes of, for example, a shell, an airplane, a star, a sweat-heart, and the like, which is not limited herein. In addition, according customers' requirements, it is possible to provide a customer LOGO (LOGOtype, logo or trademark) on an outer side of the assistive insertion member 310.

It should also be noted that, in one embodiment, to provide comfort in touch, the assistive insertion member 310 is preferably made of a soft elastic material, for example, but is not limited to silica gel or the like. Of course, in other embodiments, the assistive insertion member 310 may also be made of a hard material.

Specifically, in the structure of the zipper, the zipper teeth 110 include a first zipper teeth 110 capable of free insertion and withdrawal, the guide channels 230 include a first guide channel 230 for the first zipper teeth 110 to be inserted therethrough. The track portion 313 is provided at the same side as the first guide channel 230. The track channel 311 is formed on the track portion 313, and the track channel 311 has a track guide inlet 317 facing away from the first guide channel 230 and a track guide outlet 315 facing the first guide channel 230. The track channel 311 flares out along the width direction of the slider body 200, so that the open area of the track guide inlet 317 may be effectively increased, to allow the pin 120 be inserted into the track channel 311 at more angles, and then enter the first guide channel 230. Therefore, the purpose of further improving the insertion convenience of the zipper is achieved.

Further, please refer to FIG. 1, FIG. 3 to FIG. 5. In one embodiment, the track channel 311 flares out in a direction away from the slider body 200. In other words, the track channel 311 achieves the function of guiding into the first guide channel 230 by tapering in the track channel 311 along a direction of the assistive insertion member 310 toward the slider body, and the track guide inlet 317 should be larger than the track guide outlet 315, and also the track guide outlet 315 should be larger than or equal to the guide inlet of the first guide channel 230, so that the pin 120 may be inserted into the slider body more accurately and smoothly. In addition, to facilitate flipping the pull tab 300, in the use state, the track guide outlet 315 should be spaced from the guide inlet of the first guide channel 230 by a certain distance.

Figure 4:
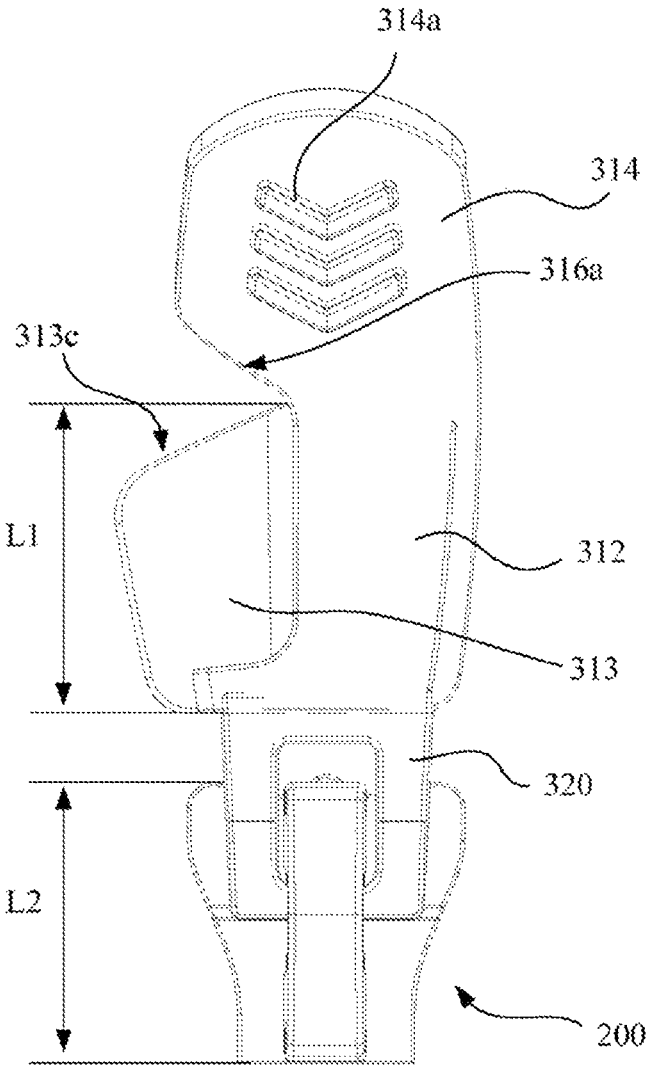
FIG. 4 is a top view of a slider of a zipper provided in one embodiment of the disclosure which is in a use state.
Figure 5:
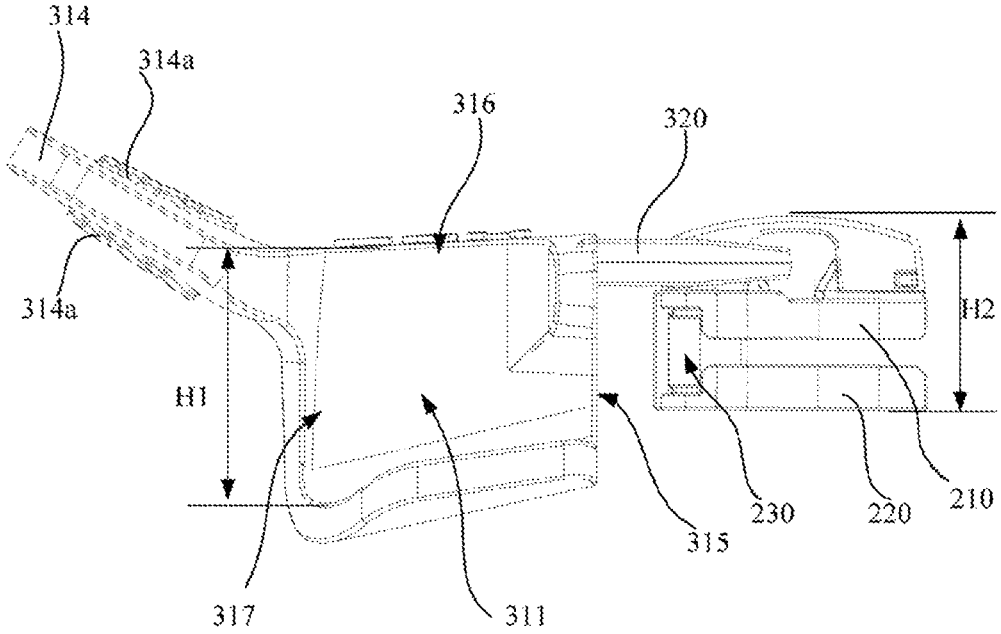
FIG. 5 is a side view of a slider of a zipper provided in one embodiment of the disclosure which is in a use state.
Figure 6:
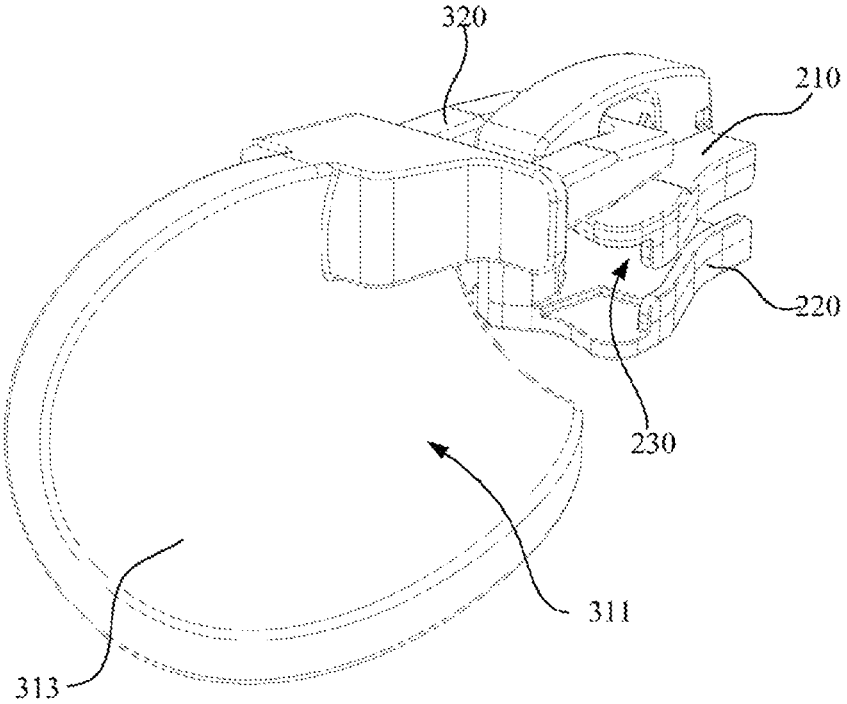
FIG. 6 is a schematic structure diagram of a slider of a zipper provided in another embodiment of the disclosure which is in a use state.
Figure 7:
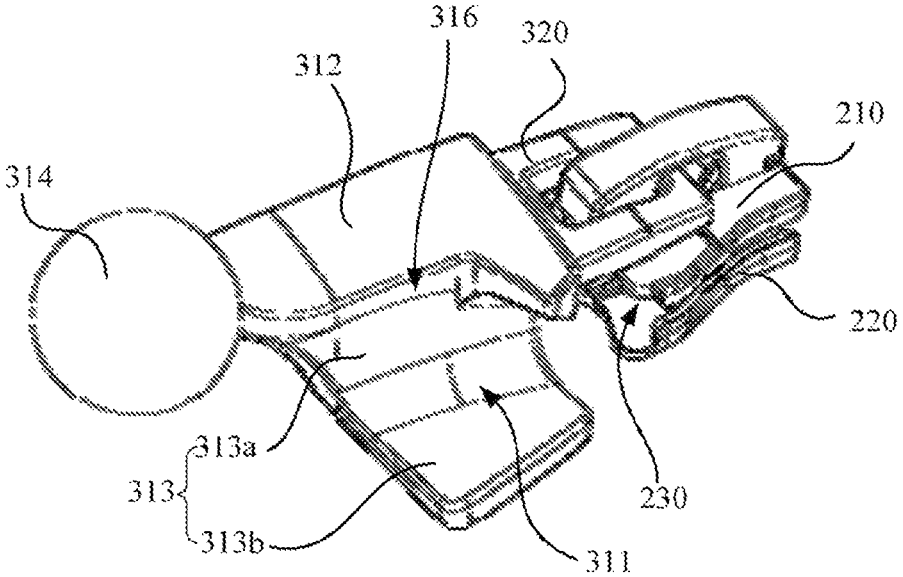
FIG. 7 is a schematic structure diagram of a slider of a zipper provided in another embodiment of the disclosure which is in a use state.
Figure 8:
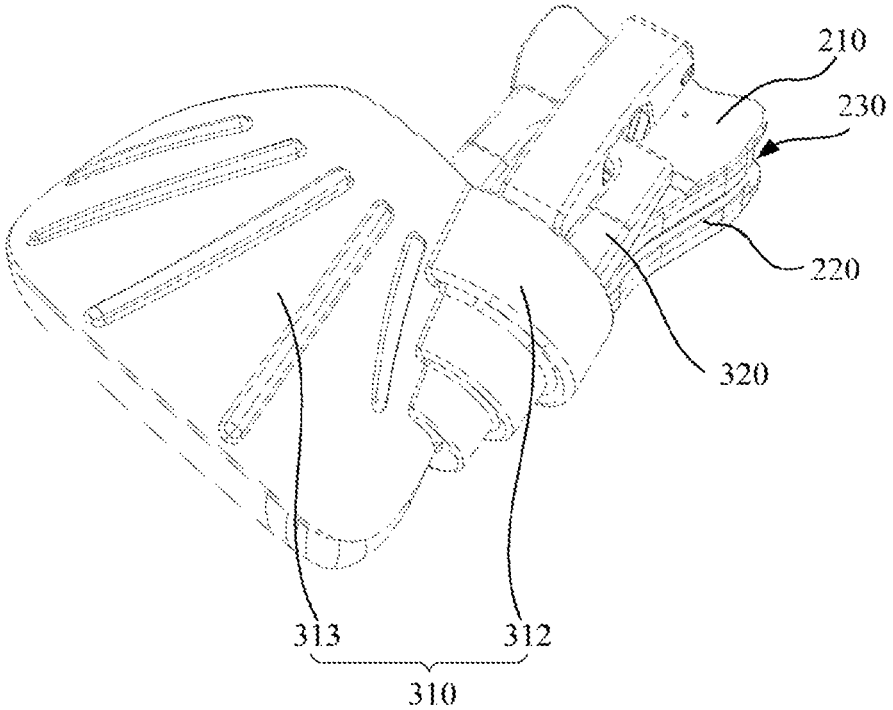
FIG. 8 is a schematic structure diagram of a slider of a zipper provided in another embodiment of the disclosure which is in a non-use state.
Figure 9:
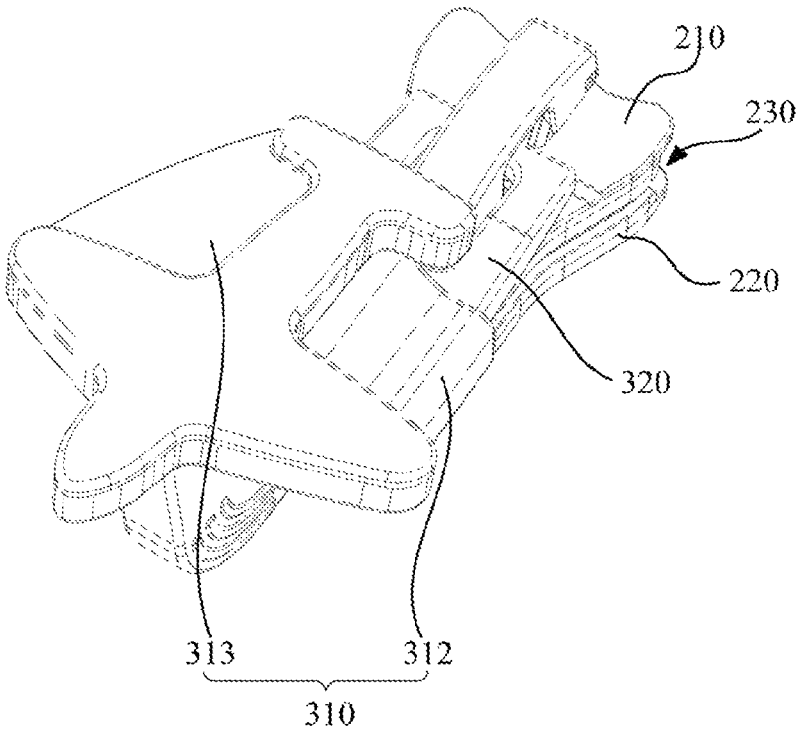
FIG. 9 is a schematic structure diagram of a slider of a zipper provided in another embodiment of the disclosure which is in a non-use state.
Figure 10:
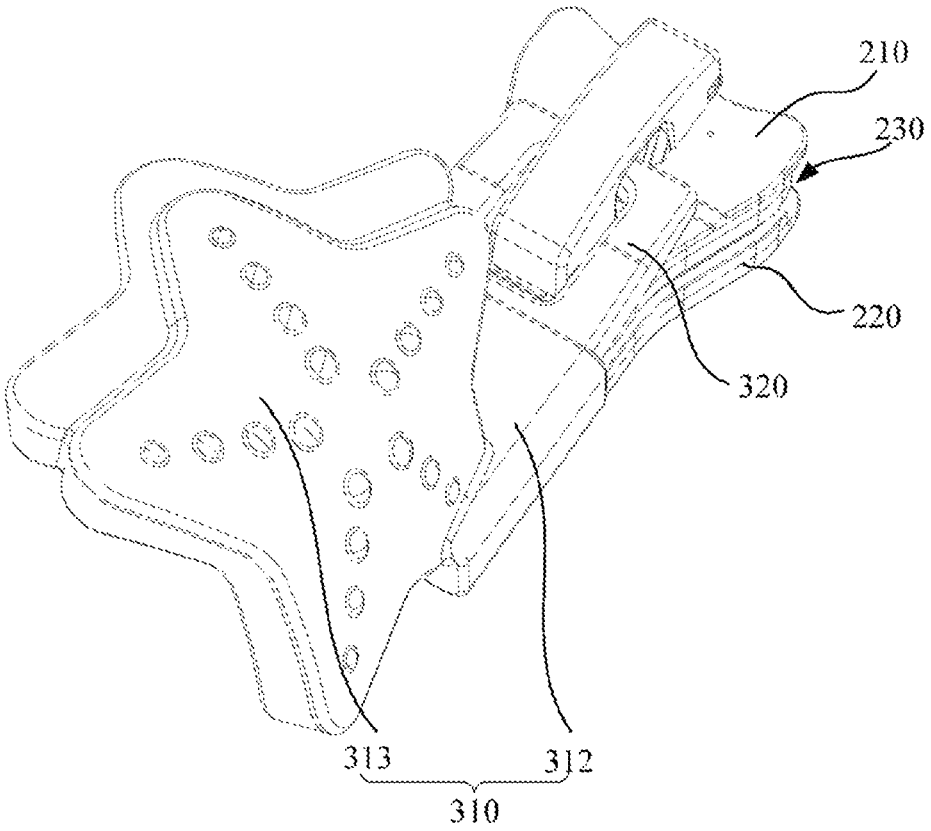
FIG. 10 is a schematic structure diagram of a slider of a zipper provided in another embodiment of the disclosure which is in a non-use state.
Figure 11:
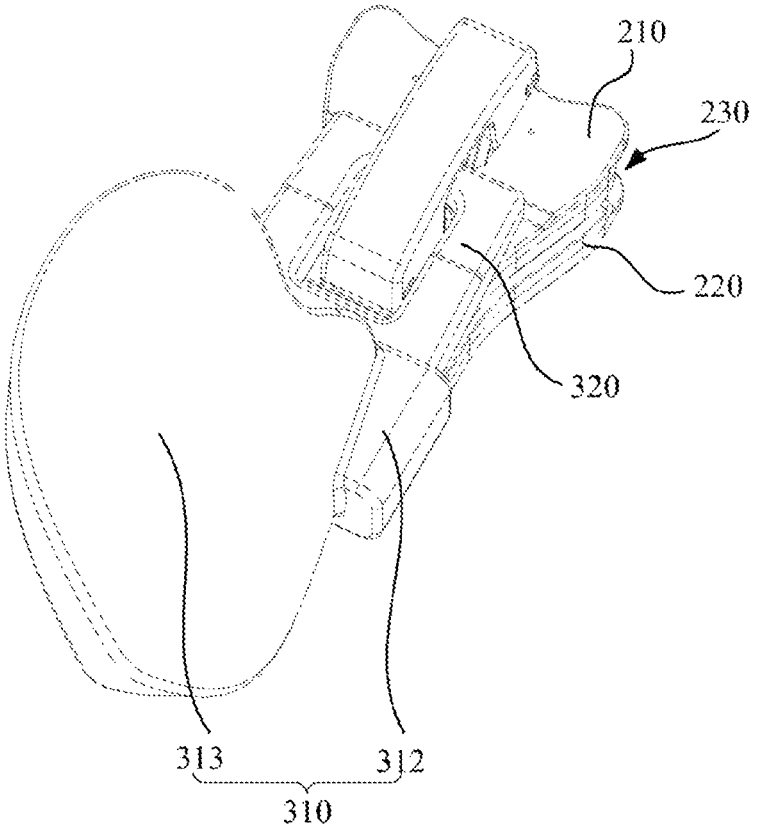
FIG. 11 is a schematic structure diagram of a slider of a zipper provided in another embodiment of the disclosure which is in a use state.

Further, as shown in FIG. 4 and FIG. 5, in one embodiment, in the length direction of the tapes 100, the length L1 of the track channel 311 is greater than the length L2 of the slider body 200; and in the width direction of the tapes 100, the width of the track channel 311 is greater than the width of the guide channel 230 at the corresponding side. It may be understood that a lengthened and widened track channel 311 helps improving the insertion convenience of the zipper. Similarly, as shown in FIG. 5, in one embodiment, the height H1 of the track channel 311 is preferably greater than the height H2 of the slider body 200, so that the insert operation of the zipper may be performed more conveniently, and the guiding function of the tapered track channel 311 in the direction from the assistive insertion member 310 towards the slider body may be ensured.

Specifically, please refer to FIG. 1 and FIG. 3 to FIG. 5. In one embodiment, in the use state, taking the direction from the upper guide plate 210 to the lower guide plate 220 as the direction from top to bottom, the cross section of the track portion 313 is L-shaped, a first track plate 313*a* is formed by extending downward from the connection portion 312, a second track plate 313*b* is formed by extending outward from a lower edge of the first track plate 313*a* in the width direction of the slider body 200, and the track channel 311 is enclosed by the inner sides of the first track plate 313*a* and the second track plate 313*b*. Thereby, the pin 120 is allowed to conveniently enter the slider body under the guide of the track channel 311. But the solutions are not limited to this. Please refer to FIG. 6. In another embodiment, also in the use state, taking the direction from the upper guide plate 210 to the lower guide plate 220 as the direction from top to bottom, the track portion 313 is provided as a one-piece downwardly curved plate, the inner side of the curved plate is a smooth curved surface, and the track channel 311 is enclosed by the inner side of the curved plate. That is, the track channel 311 radially flares out along an axis which is the center line of the first guide channel 230. In this way, the pin 120 may also be allowed to enter the slider body through the guide of the track channel 311.

Further, please refer to FIG. 1 and FIG. 3. In an embodiment, the connection portion 312 has a notch 316 in communication with the track channel 311. Specifically, the length of the notch 316 is less than or equal to the length of the pin 120 of the first zipper teeth 110. In the use state, taking the direction from the upper guide plate 210 to the lower guide plate 220 as the direction from top to bottom, on one hand, it is possible to know the insertion state of the pin 120 from the notch 316 during the insert operation, and on the other hand, the notch 316 breaks the limit of the track portion 313 in the upward direction, thereby effectively expands the actual inlet area entering the track channel 311, and thus achieves the purpose of further facilitating the insert operation of the zipper. Certainly, to ensure the guiding function of the tapered track channel 311 in the direction from the assistive insertion member 310 toward the slider body. Further, a guide baffle is provided in front of the notch 316, and the lower edge of the guide baffle and the front edge of the second track plate 313*b* form the track guide outlet 315.

Further, please refer to FIG. 4. In one embodiment, in the use state, taking the direction from the slider body 200 to the assistive insertion member 310 as the direction from front to rear, the notch 316 has a notch rear edge 316*a* away from the slider body 200, and the track portion 313 has a track rear edge 313*c* away from the slider body 200. In the width direction of the slider body 200, the notch rear edge 316*a* is arranged to be tilted backwards, and the track rear edge 313*c* is arranged to be tilted forwards. In other words, the notch rear edge 316*a* and the track rear edge 313*c* are arranged at an angle to each other, so that the actual area of the track guide inlet 317 is enlarged, thereby facilitating the insert operation of the zipper. In addition, each edge of the assistive insertion member 310 is round cornered, so as to prevent a sharp corner from scratching a finger.

To conveniently pull the pull tab 300, the assistive insertion member 310 further includes a grip portion 314, which is disposed at an end of the connection portion 312 and the track portion 313 facing away from the slider body 200, and is preferably integrally disposed with the assistive insertion member 310. Here, the grip portion 314 may be designed to be in various shapes of, for example, a plate as shown in FIG. 2 to FIG. 5, or a sphere in another embodiment shown in FIG. 7, and the spherical grip portion 314 facilitates complete and stable gripping by the finger.

As shown in FIG. 5, in one embodiment, in the use state, taking the direction from the slider body 200 to the assistive insertion member 310 as the direction from front to rear and taking the direction from the upper guide plate 210 to the lower guide plate 220 as the direction from top to bottom, the grip portion 314 is arranged to be tilted upwards in the backward direction. In other words, the grip portion 314 has a shape that tilts backwards and upwards, and the tilting angle is preferably 0-90 degrees. In this way, the tilting arrangement of the grip portion 314 further facilitates pulling the pull tab 300.

Further, please refer to FIG. 1 to FIG. 5. In one embodiment, anti-slip ribs 314*a* are provided on the grip portion 314, and the anti-slip ribs 314*a* mainly function to prevent fingers from slipping as the fingers pinch the grip portion 314. The anti-slip ribs may be a plurality of bent anti-slip ribs 314*a* shown in FIG. 3, which are arranged at intervals on the upper and lower surfaces of the grip portion 314, or may be in other shapes, which is not limited herein.

The above only provides optional embodiments of the disclosure, and is not intended to limit it. Various modifications and changes may be possible for those skilled in the art. Any modification, equivalent replacement, improvement, etc. made within the spirit and principle of the disclosure shall fall within the scope of the claims of the disclosure.

What is claimed is:

1. A slider of a zipper comprising tapes arranged at opposing left side and right side and zipper teeth arranged on the tapes, wherein the slider of the zipper comprises:

a slider body comprising an upper guide plate and a lower guide plate connected to each other, wherein two guide channels at the left side and the right side are formed between the upper guide plate and the lower guide plate to engage and separate the zipper teeth, and one guide channel of the two guide channels at one side allows insertion and withdrawal of the zipper teeth at corresponding side;

a pull tab movably connected to the upper guide plate, wherein the pull tab comprises an assistive insertion member on which a track channel running through two ends of the assistive insertion member is formed; the assistive insertion member is able to be flipped upwards relative to the slider body in a length direction of the slider body, such that the track channel is in communication with a guide channel of the two guide channels at a corresponding side, and a pin of the zipper teeth at the corresponding side is allowed to enter inside of the slider body through the track channel;

the assistive insertion member comprises a connection portion connected to the upper guide plate and a track portion connected to the connection portion, the assistive insertion member has a use state resulted from flipping the connection portion together with the track portion upwards relative to the upper guide plate;

the zipper teeth comprise a first zipper teeth capable of free insertion and withdrawal, the two guide channels comprise a first guide channel for insertion of the first zipper teeth; the track portion is provided at same side as the first guide channel, the track channel is formed on the track portion, and the track channel has a track guide inlet facing away from the first guide channel and a track guide outlet facing the first guide channel;

the track channel flares out along a width direction of the slider body; and in the use state, taking a direction from the upper guide plate to the lower guide plate as a direction from top to bottom, cross section of the track portion is L-shaped, and the track portion comprises a first track plate and a second track plate, wherein the first track plate is formed by extending downward from the connection portion, the second track plate is formed by extending outward from a lower edge of the first track plate in the width direction of the slider body, and the track channel is enclosed by inner sides of the first track plate and the second track plate.

2. The slider of the zipper according to claim 1, wherein in the use state, taking a direction from the upper guide plate to the lower guide plate as a direction from top to bottom, the track portion is provided as a one-piece downwardly curved plate, an inner side of the curved plate is a smooth curved surface, and the track channel is enclosed by the inner side of the curved plate.

3. The slider of the zipper according to claim 1, wherein the connection portion is provided with a notch in communication with the track channel.

4. The slider of the zipper according to claim 3, wherein a length of the notch is less than or equal to a length of a pin of the first zipper teeth.

5. The slider of the zipper according to claim 3, wherein in the use state, taking a direction from the slider body to the assistive insertion member as a direction from front to rear, the notch has a notch rear edge away from the slider body, and the track portion has a track rear edge away from the slider body; and in the width direction of the slider body, the notch rear edge is arranged to be tilted backwards, and the track rear edge is arranged to be tilted forwards.

6. The slider of the zipper according to claim 1, wherein the assistive insertion member further comprises a grip portion disposed at an end of the connection portion and the track portion facing away from the slider body.

7. The slider of the zipper according to claim 6, wherein in the use state, taking a direction from the slider body to the assistive insertion member as a direction from front to rear and taking a direction from the upper guide plate to the lower guide plate as a direction from top to bottom, the grip portion is arranged to be tilted upwards in a backward direction.

8. The slider of the zipper according to claim 7, wherein anti-slip ribs are provided on the grip portion.

9. The slider of the zipper according to claim 1, wherein the pull tab further comprises a connecting member, one end of the connecting member is pivotally connected to the upper guide plate, and other end of the connecting member is fixedly connected to the assistive insertion member; or the connecting member is integrally provided with the assistive insertion member, and one end of the connecting member facing the slider body is pivotally connected to the upper guide plate.

10. The slider of the zipper according to claim 1, wherein the assistive insertion member is made of a soft elastic material.

11. The slider of the zipper according to claim 1, wherein the track channel flares out in a direction away from the slider body.

12. The slider of the zipper according to claim 1, wherein in a length direction of the tapes, a length of the track channel is greater than a length of the slider body; and in a width direction of the tapes, a width of the track channel is greater than a width of the guide channel of the two guide channels at the corresponding side.

13. The slider of the zipper according to claim 12, wherein a height of the track channel is greater than a height of the slider body.

14. A zipper comprising a slider, tapes arranged at opposing left side and right side and zipper teeth arranged on the tapes, wherein the slider of the zipper comprises:

a slider body comprising an upper guide plate and a lower guide plate connected to each other, wherein two guide channels at the left side and the right side are formed between the upper guide plate and the lower guide plate to engage and separate the zipper teeth, and one guide channel of the two guide channels at one side allows insertion and withdrawal of the zipper teeth at corresponding side;

a pull tab movably connected to the upper guide plate, wherein the pull tab comprises an assistive insertion member on which a track channel running through two ends of assistive insertion member is formed; the assistive insertion member is able to be flipped upwards relative to the slider body in a length direction of the slider body, such that the track channel is in communication with a guide channel of the two guide channels at a corresponding side, and a pin of the zipper teeth at the corresponding side is allowed to enter inside of the slider body through the track channel;

the assistive insertion member comprises a connection portion connected to the upper guide plate and a track portion connected to the connection portion, the assistive insertion member has a use state resulted from flipping the connection portion together with the track portion upwards relative to the upper guide plate;

the zipper teeth comprise a first zipper teeth capable of free insertion and withdrawal, the two guide channels comprise a first guide channel for insertion of the first zipper teeth; the track portion is provided at same side as the first guide channel, the track channel is formed on the track portion, and the track channel has a track guide inlet facing away from the first guide channel and a track guide outlet facing the first guide channel;

the track channel flares out along a width direction of the slider body; and in the use state, taking a direction from the upper guide plate to the lower guide plate as a direction from top to bottom, cross section of the track portion is L-shaped, and the track portion comprises a first track plate and a second track plate, wherein the first track plate is formed by extending downward from the connection portion, the second track plate is formed by extending outward from a lower edge of the first track plate in the width direction of the slider body, and the track channel is enclosed by inner sides of the first track plate and the second track plate.

15. The zipper according to claim 14, wherein in the use state, taking a direction from the upper guide plate to the lower guide plate as a direction from top to bottom, the track portion is provided as a one-piece downwardly curved plate, an inner side of the curved plate is a smooth curved surface, and the track channel is enclosed by the inner side of the curved plate.

16. The zipper according to claim 14, wherein the connection portion is provided with a notch in communication with the track channel.

* * * * *